US008154481B2

(12) United States Patent
Lee et al.

(10) Patent No.: US 8,154,481 B2
(45) Date of Patent: Apr. 10, 2012

(54) METHOD FOR MANAGING DISPLAY MEMORY DATA OF LIGHT EMITTING DISPLAY

(75) Inventors: Kyoung-Soo Lee, Suwon-si (KR); June-Young Song, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1114 days.

(21) Appl. No.: 11/208,440

(22) Filed: Aug. 18, 2005

(65) Prior Publication Data

US 2006/0038757 A1 Feb. 23, 2006

(30) Foreign Application Priority Data

Aug. 20, 2004 (KR) ..... 10-2004-0065778

(51) Int. Cl.
*G09G 3/30* (2006.01)

(52) U.S. Cl. ..... 345/77; 345/76; 345/82; 345/83

(58) Field of Classification Search ..... 345/54, 345/76–100, 690
See application file for complete search history.

(56) References Cited

U.S. PATENT DOCUMENTS

| | | | | |
|---|---|---|---|---|
| 5,019,807 | A | 5/1991 | Stapleton et al. | |
| 5,812,105 | A | 9/1998 | Van de Ven | |
| 5,982,345 | A | 11/1999 | Takayama et al. | |
| 6,011,530 | A | 1/2000 | Kawahata et al. | |
| 6,069,597 | A | 5/2000 | Hansen | |
| 6,097,365 | A | 8/2000 | Makino | |
| 6,144,352 | A | 11/2000 | Matsuda et al. | |
| 6,380,689 | B1 * | 4/2002 | Okuda | 315/169.3 |
| 6,411,047 | B1 | 6/2002 | Okazaki et al. | |
| 6,421,033 | B1 | 7/2002 | Williams et al. | |
| 6,618,031 | B1 * | 9/2003 | Bohn et al. | 345/83 |
| 6,703,991 | B2 * | 3/2004 | Salters et al. | 345/63 |
| 6,707,441 | B1 | 3/2004 | Hebiguchi et al. | |

(Continued)

FOREIGN PATENT DOCUMENTS

CN 1490779 4/2004

(Continued)

OTHER PUBLICATIONS

European Search Report for EP 05107585.1-2205 dated Dec. 22, 2005.

(Continued)

*Primary Examiner* — Amare Mengistu
*Assistant Examiner* — Koosha Sharifi
(74) *Attorney, Agent, or Firm* — Christie, Parker & Hale, LLP

(57) ABSTRACT

A memory managing method for display data of a light emitting display device, which uses field light-emitting of organic materials. A plurality of pixels are each provided with at least two sub-pixels to emit different color lights, wherein one field has at least first and second subfields divided and driven independently. At least two data signals corresponding to substantially the same color are time-divided and applied to a data line during the one field, and selecting signals are sequentially applied to a plurality of scan lines at the first and second subfields. The method includes a) dividing input data corresponding to a display image into data for the first and second subfields, b) arranging the data for the first and second subfields according to a sequence of light-emitting driving, and c) storing the arranged data as pixel-based data.

12 Claims, 15 Drawing Sheets

U.S. PATENT DOCUMENTS

| | | | | |
|---|---|---|---|---|
| 6,919,868 | B2 * | 7/2005 | Tam | 345/76 |
| 6,943,766 | B2 * | 9/2005 | Nakamura et al. | 345/98 |
| 7,119,770 | B2 | 10/2006 | Moon | |
| 7,129,914 | B2 | 10/2006 | Knapp et al. | |
| 7,319,471 | B2 * | 1/2008 | Natori et al. | 345/690 |
| 7,336,247 | B2 | 2/2008 | Akimoto et al. | |
| 2001/0043169 | A1 * | 11/2001 | Salters et al. | 345/60 |
| 2002/0036610 | A1 * | 3/2002 | Ito et al. | 345/89 |
| 2002/0063701 | A1 * | 5/2002 | Sano et al. | 345/204 |
| 2002/0067327 | A1 * | 6/2002 | Ozawa et al. | 345/89 |
| 2002/0070909 | A1 | 6/2002 | Asano et al. | |
| 2002/0126074 | A1 | 9/2002 | Ouellette et al. | |
| 2002/0140659 | A1 * | 10/2002 | Mikami et al. | 345/90 |
| 2002/0149598 | A1 * | 10/2002 | Greier et al. | 345/589 |
| 2003/0030601 | A1 * | 2/2003 | Komiya | 345/76 |
| 2003/0142056 | A1 * | 7/2003 | Okamoto | 345/90 |
| 2003/0184505 | A1 | 10/2003 | Inukai et al. | |
| 2003/0222835 | A1 * | 12/2003 | Yoon et al. | 345/60 |
| 2003/0231152 | A1 | 12/2003 | Shin | |
| 2004/0183764 | A1 * | 9/2004 | Kim et al. | 345/88 |
| 2004/0212633 | A1 * | 10/2004 | Natori et al. | 345/694 |
| 2004/0217932 | A1 * | 11/2004 | Nally et al. | 345/92 |
| 2005/0052365 | A1 * | 3/2005 | Jang | 345/76 |
| 2005/0168490 | A1 | 8/2005 | Takahara | |
| 2006/0007073 | A1 * | 1/2006 | Kwak et al. | 345/76 |
| 2006/0061600 | A1 * | 3/2006 | Beuker et al. | 345/656 |
| 2007/0152923 | A1 * | 7/2007 | Baik et al. | 345/76 |

FOREIGN PATENT DOCUMENTS

| | | | |
|---|---|---|---|
| CN | 1495699 | A | 5/2004 |
| EP | 0 241 562 | A1 | 10/1987 |
| EP | 0 637 009 | A2 | 2/1995 |
| EP | 0 637 009 | A3 | 3/1997 |
| EP | 1 441 325 | A2 | 7/2004 |
| EP | 1 441 325 | A3 | 12/2004 |
| EP | 1 536 406 | A1 | 6/2005 |
| EP | 1 594 118 | A1 | 11/2005 |
| JP | 9-138659 | | 5/1997 |
| JP | 2002-244619 | | 8/2002 |
| JP | 2003-510661 | | 3/2003 |
| JP | 2003-122306 | | 4/2003 |
| JP | 2003-259253 | | 9/2003 |
| JP | 2004-078210 | | 3/2004 |
| JP | 2004-133240 | | 4/2004 |
| JP | 2004-233447 | | 8/2004 |
| JP | 2005-157258 | | 6/2005 |
| JP | 2005-520193 | | 7/2005 |
| WO | WO 01/24153 | | 4/2001 |
| WO | WO 03/077231 | A2 | 9/2003 |

OTHER PUBLICATIONS

U.S. Office action dated Jan. 23, 2009, for related U.S. Appl. No. 11/157,898, noting U.S. reference in this IDS, except U.S. Publications 2003/0231152 and 2005/0168490, and U.S. Patent 6,421,033.

Patent Abstracts of Japan, Publication No. 09-138659, dated May 27, 1997, in the name of Chan-Long Shieh et al.

Patent Abstracts of Japan, Publication No. 2002-244619, dated Aug. 30, 2002, in the name of Munenori Ono.

Patent Abstracts of Japan, Publication No. 2003-122306, dated Apr. 25, 2003, in the name of Akira Yumoto.

Patent Abstracts of Japan, Publication No. 2004-133240, dated Apr. 30, 2004, in the name of Shin Asano et al.

U.S. Office action dated Dec. 29, 2009, for related U.S. Appl. No. 11/157,898, noting listed U.S. references 7,119,770 in this IDS.

Notice of Allowance dated Oct. 19, 2010, for corresponding Japanese Application No. 2005-236882, listing the references cited in this IDS as well as JP 2003-122306 previously cited in an IDS dated Jun. 11, 2009.

* cited by examiner

Fig. 7

| | | | | | |
|---|---|---|---|---|---|
| 1 Line | R(1, 1)<br>G(1, 1)<br>B(1, 1) | R(1, 2)<br>G(1, 2)<br>B(1, 2) | R(1, 3)<br>G(1, 3)<br>B(1, 3) | . . .<br>. . .<br>. . . | R(1, 6n)<br>G(1, 6n)<br>B(1, 6n) |
| 2 Line | R(2, 1)<br>G(2, 1)<br>B(2, 1) | R(2, 2)<br>G(2, 2)<br>B(2, 2) | R(2, 3)<br>G(2, 3)<br>B(2, 3) | . . .<br>. . .<br>. . . | R(2, 6n)<br>G(2, 6n)<br>B(2, 6n) |
| 3 Line | R(3, 1)<br>G(3, 1)<br>B(3, 1) | R(3, 2)<br>G(3, 2)<br>B(3, 2) | R(3, 3)<br>G(3, 3)<br>B(3, 3) | . . .<br>. . .<br>. . . | R(3, 6n)<br>G(3, 6n)<br>B(3, 6n) |
| 4 Line | R(4, 1)<br>G(4, 1)<br>B(4, 1) | R(4, 2)<br>G(4, 2)<br>B(4, 2) | R(4, 3)<br>G(4, 3)<br>B(4, 3) | . . .<br>. . .<br>. . . | R(4, 6n)<br>G(4, 6n)<br>B(4, 6n) |
| .<br>.<br>. | .<br>.<br>. | .<br>.<br>. | .<br>.<br>. | .<br>.<br>. | .<br>.<br>. |

6n

Fig. 8A

Odd Field

| | | | | | | | | |
|---|---|---|---|---|---|---|---|---|
| R(1, 1) | B(1, 1) | G(1, 2) | R(1, 3) | B(1, 3) | G(1, 4) | R(1, 5) | B(1, 5) | G(1, 6) |
| G(2, 1) | R(2, 2) | B(2, 2) | G(2, 3) | R(2, 4) | B(2, 4) | G(2, 5) | R(2, 6) | B(2, 6) |
| R(3, 1) | B(3, 1) | G(3, 2) | R(3, 3) | B(3, 3) | G(3, 4) | R(3, 5) | B(3, 5) | G(3, 6) |
| G(4, 1) | R(4, 2) | B(4, 2) | G(4, 3) | R(4, 4) | B(4, 4) | G(4, 5) | R(4, 6) | B(4, 6) |

| | | | | | | | | |
|---|---|---|---|---|---|---|---|---|
| R(1, 1) | B(1, 1) | G(1, 2) | R(1, 3) | B(1, 3) | G(1, 4) | R(1, 5) | B(1, 5) | G(1, 6) |
| G(2, 1) | R(2, 2) | B(2, 2) | G(2, 3) | R(2, 4) | B(2, 4) | G(2, 5) | R(2, 6) | B(2, 6) |
| R(3, 1) | B(3, 1) | G(3, 2) | R(3, 3) | B(3, 3) | G(3, 4) | R(3, 5) | B(3, 5) | G(3, 6) |
| G(4, 1) | R(4, 2) | B(4, 2) | G(4, 3) | R(4, 4) | B(4, 4) | G(4, 5) | R(4, 6) | B(4, 6) |

Fig. 8B

Even Field

| | | | | | | | | |
|---|---|---|---|---|---|---|---|---|
| G(1, 1) | R(1, 2) | B(1, 2) | G(1, 3) | R(1, 4) | B(1, 4) | G(1, 5) | R(1, 6) | B(1, 6) |
| R(2, 1) | B(2, 1) | G(2, 2) | R(2, 3) | B(2, 3) | G(2, 4) | R(2, 5) | B(2, 5) | G(2, 6) |
| G(3, 1) | R(3, 2) | B(3, 2) | G(3, 3) | R(3, 4) | B(3, 4) | G(3, 5) | R(3, 6) | B(3, 6) |
| R(4, 1) | B(4, 1) | G(4, 2) | R(4, 3) | B(4, 3) | G(4, 4) | R(4, 5) | B(4, 5) | G(4, 6) |

| | | | | | | | | |
|---|---|---|---|---|---|---|---|---|
| G(1, 1) | R(1, 2) | B(1, 2) | G(1, 3) | R(1, 4) | B(1, 4) | G(1, 5) | R(1, 6) | B(1, 6) |
| R(2, 1) | B(2, 1) | G(2, 2) | R(2, 3) | B(2, 3) | G(2, 4) | R(2, 5) | B(2, 5) | G(2, 6) |
| G(3, 1) | R(3, 2) | B(3, 2) | G(3, 3) | R(3, 4) | B(3, 4) | G(3, 5) | R(3, 6) | B(3, 6) |
| R(4, 1) | B(4, 1) | G(4, 2) | R(4, 3) | B(4, 3) | G(4, 4) | R(4, 5) | B(4, 5) | G(4, 6) |

Fig. 9A

| | k | 0 | 1 | 2 | | n-1 |
|---|---|---|---|---|---|---|
| 1 Line | S(3k+1) | R(1, 1) | R(1, 3) | R(1, 5) | . . . | R(1, 6n-1) |
| | S(3k+2) | B(1, 1) | B(1, 3) | B(1, 5) | . . . | B(1, 6n-1) |
| | S(3k+3) | G(1, 2) | G(1, 4) | G(1, 6) | . . . | G(1, 6n) |
| 2 Line | S(3k+1) | G(2, 1) | G(2, 3) | G(2, 5) | . . . | G(2, 6n-1) |
| | S(3k+2) | R(2, 2) | R(2, 4) | R(2, 6) | . . . | R(2, 6n) |
| | S(3k+3) | B(2, 2) | B(2, 4) | B(2, 6) | . . . | B(2, 6n) |
| 3 Line | S(3k+1) | R(3, 1) | R(3, 3) | R(3, 5) | . . . | R(3, 6n-1) |
| | S(3k+2) | B(3, 1) | B(3, 3) | B(3, 5) | . . . | B(3, 6n-1) |
| | S(3k+3) | G(3, 2) | G(3, 4) | G(3, 6) | . . . | G(3, 6n) |
| 4 Line | S(3k+1) | G(4, 1) | G(4, 3) | G(4, 5) | . . . | G(4, 6n-1) |
| | S(3k+2) | R(4, 2) | R(4, 4) | R(4, 6) | . . . | R(4, 6n) |
| | S(3k+3) | B(4, 2) | B(4, 4) | B(4, 6) | . . . | B(4, 6n) |
| ⋮ | ⋮ | ⋮ | ⋮ | ⋮ | ⋮ | ⋮ |

3n

Fig. 9B

| | k | 0 | 1 | 2 | | n-1 |
|---|---|---|---|---|---|---|
| 1 Line | S(3k+1) | G(1, 1) | G(1, 3) | G(1, 5) | . . . | G(1, 6n-1) |
| | S(3k+2) | R(1, 2) | R(1, 4) | R(1, 6) | . . . | R(1, 6n) |
| | S(3k+3) | B(1, 2) | B(1, 4) | B(1, 6) | . . . | B(1, 6n) |
| 2 Line | S(3k+1) | R(2, 1) | R(2, 3) | R(2, 5) | . . . | R(2, 6n-1) |
| | S(3k+2) | B(2, 1) | B(2, 3) | B(2, 5) | . . . | B(2, 6n-1) |
| | S(3k+3) | G(2, 2) | G(2, 4) | G(2, 6) | . . . | G(2, 6n) |
| 3 Line | S(3k+1) | G(3, 1) | G(3, 3) | G(3, 5) | . . . | G(3, 6n-1) |
| | S(3k+2) | R(3, 2) | R(3, 4) | R(3, 6) | . . . | R(3, 6n) |
| | S(3k+3) | B(3, 2) | B(3, 4) | B(3, 6) | . . . | B(3, 6n) |
| 4 Line | S(3k+1) | R(4, 1) | R(4, 3) | R(4, 5) | . . . | R(4, 6n-1) |
| | S(3k+2) | B(4, 1) | B(4, 3) | B(4, 5) | . . . | B(4, 6n-1) |
| | S(3k+3) | G(4, 2) | G(4, 4) | G(4, 6) | . . . | G(4, 6n) |
| ⋮ | ⋮ | ⋮ | ⋮ | ⋮ | ⋮ | ⋮ |

3n

Fig. 14A

| | k | 0 | 1 | 2 | | n-1 |
|---|---|---|---|---|---|---|
| 1 Line | S(3k+1) | R(1, 1) | R(1, 3) | R(1, 5) | . . . | R(1, 6n-1) |
| | S(3k+2) | G(1, 2) | G(1, 4) | G(1, 6) | . . . | G(1, 6n) |
| | S(3k+3) | B(1, 1) | B(1, 3) | B(1, 5) | . . . | B(1, 6n-1) |
| 2 Line | S(3k+1) | R(2, 2) | R(2, 4) | R(2, 6) | . . . | R(2, 6n) |
| | S(3k+2) | G(2, 1) | G(2, 3) | G(2, 5) | . . . | G(2, 6n-1) |
| | S(3k+3) | B(2, 2) | B(2, 4) | B(2, 6) | . . . | B(2, 6n) |
| 3 Line | S(3k+1) | R(3, 1) | R(3, 3) | R(3, 5) | . . . | R(3, 6n) |
| | S(3k+2) | G(3, 2) | G(3, 4) | G(3, 6) | . . . | G(3, 6n-1) |
| | S(3k+3) | B(3, 1) | B(3, 3) | B(3, 5) | . . . | B(3, 6n) |
| 4 Line | S(3k+1) | R(4, 2) | R(4, 4) | R(4, 6) | . . . | R(4, 6n-1) |
| | S(3k+2) | G(4, 1) | G(4, 3) | G(4, 5) | . . . | G(4, 6n) |
| | S(3k+3) | B(4, 2) | B(4, 4) | B(4, 6) | . . . | B(4, 6n-1) |
| . . . | . . . | . . . | . . . | . . . | . . . | . . . |

3n

Fig. 14B

| | k | 0 | 1 | 2 | | n-1 |
|---|---|---|---|---|---|---|
| 1 Line | S(3k+1) | R(1, 2) | R(1, 4) | R(1, 6) | . . . | R(1, 6n) |
| | S(3k+2) | G(1, 1) | G(1, 3) | G(1, 5) | . . . | G(1, 6n-1) |
| | S(3k+3) | B(1, 2) | B(1, 4) | B(1, 6) | . . . | B(1, 6n) |
| 2 Line | S(3k+1) | R(2, 1) | R(2, 3) | R(2, 5) | . . . | R(2, 6n-1) |
| | S(3k+2) | G(2, 2) | G(2, 4) | G(2, 6) | . . . | G(2, 6n) |
| | S(3k+3) | B(2, 1) | B(2, 3) | B(2, 5) | . . . | B(2, 6n-1) |
| 3 Line | S(3k+1) | R(3, 2) | R(3, 4) | R(3, 6) | . . . | R(3, 6n-1) |
| | S(3k+2) | G(3, 1) | G(3, 3) | G(3, 5) | . . . | G(3, 6n) |
| | S(3k+3) | B(3, 2) | B(3, 4) | B(3, 6) | . . . | B(3, 6n-1) |
| 4 Line | S(3k+1) | R(4, 1) | R(4, 3) | R(4, 5) | . . . | R(4, 6n) |
| | S(3k+2) | G(4, 2) | G(4, 4) | G(4, 6) | . . . | G(4, 6n-1) |
| | S(3k+3) | B(4, 1) | B(4, 3) | B(4, 5) | . . . | B(4, 6n) |
| . . . | . . . | . . . | . . . | . . . | . . . | . . . |

3n

METHOD FOR MANAGING DISPLAY MEMORY DATA OF LIGHT EMITTING DISPLAY

CROSS REFERENCE TO RELATED APPLICATION

This application claims priority to and the benefit of Korean Patent Application No. 10-2004-0065778 filed on Aug. 20, 2004 in the Korean Intellectual Property Office, the entire content of which is incorporated herein by reference.

BACKGROUND OF THE INVENTION

1. Field of the Invention

The present invention relates to a method for managing display memory data of a light emitting display, and more particularly, it relates to a method for managing display memory data of an organic light emitting display (referred to as an "OLED" hereinafter) using light emission of organic materials.

2. Description of the Related Art

Generally, an active matrix display such as a liquid crystal display and an OLED includes a plurality of scan lines arranged in the row direction and a plurality of data lines arranged in the column direction at the display area. Neighboring scan lines and data lines define each pixel area, and a plurality of pixels are formed in the pixel areas in a matrix format. Each pixel includes an active element, that is, a transistor to transmit a data signal provided through the data line in response to a selecting signal transmitted through a selecting scan line. Accordingly, the above-noted display needs a data driver for driving data lines and a scan driver for driving selecting scan lines.

Also, the above-noted display has further data lines coupled with red, green, and blue (R, G, B) pixels arranged continuously in a row direction in order that it may display various colors by combining the brightness of R pixels for emitting red light (hereinafter referred to as "R"), the brightness of G pixels for emitting green light (hereinafter referred to as "G"), and the brightness of B pixels for emitting blue light (hereinafter referred to as "B").

Each pixel includes a plurality of sub-pixels for various colors, and the various colors are displayed by combining lights of various colors emitted from such sub-pixels. Generally, each pixel includes a sub-pixel to display R, a sub-pixel to display G, and a sub-pixel to display B such that these R, G, and B sub-pixels are combined to display various colors.

Also, since the data driver converts digital signals into analog signals to apply the analog signals to the data lines, the data driver typically has output terminals of as many as the number of data lines. The data driver is generally manufactured with a plurality of ICs, which respectively has a limited number of the output terminals, and hence, many ICs are required to drive the data lines. Also, since many transistors, capacitors, and lines for transmitting voltages or signals are required for one pixel, it is difficult to arrange these elements in a single pixel. Further, since data lines are respectively formed corresponding to the R, G, and B pixels at the limited display area and the drivers for driving theses pixels are respectively formed therein, there is a problem in which the aperture ratio of pixels is reduced.

SUMMARY OF THE INVENTION

Accordingly, in one exemplary embodiment according to the present invention, a method for managing a display memory of a light emitting display including a method for managing sorting of data stored in the memory of the light-emitting display into a predetermined form adapted to a light-emitting driving method, is provided.

In an exemplary embodiment according to the present invention, a memory managing method for display data of a light emitting display device is provided. The light emitting display device includes a plurality of pixels each including at least two sub-pixels for emitting different color lights. A field is divided into a plurality of subfields including a first subfield and a second subfield, and at least two data signals corresponding to substantially the same color are time-divided and are applied to a data line in the field having the plurality of subfields. Selecting signals are sequentially applied to a plurality of scan lines in the first and second subfields.

The display data of a display image are divided into data for the first and second subfields, wherein the display data includes data corresponding to the at least two data signals. The data of the first and second subfields are arranged according to a sequence of light-emitting driving. The arranged data are stored as pixel-based data.

The light-emitting driving may include time-divided driving of adjacent sub-pixels and/or time-divided driving of sub-pixels of the same color. The pixel-based data may be stored according to a predetermined sequence of reading the data from a memory in accordance with a memory map of the memory, which may have 3n data in a column direction of the first and second subfields when 6n display data are supplied in a column direction, wherein n is a positive integer. The memory map may correspond to the scan lines for selecting signals $S(3k+1)$, $S(3k+2)$, or $S(3k+3)$, where $k=0, 1, 2, \ldots, n-1$ for each line.

In another exemplary embodiment according to the present invention, a light emitting display sorts display data into a form that can be read easily from the memory, and stores and manages the sorted display data, thereby reducing the data access time and enhancing the memory efficiency.

In yet another exemplary embodiment according to the present invention, a light emitting display device is provided. The light emitting display device includes a data driver, a scan driver, a plurality pixels and a memory. The data driver provides a plurality of data signals over a plurality of data lines during a field including at least first and second subfields. The scan driver provides a plurality of selecting signals over a plurality of scan lines. The pixels are coupled to the data lines and the scan lines, and each pixel includes at least two sub-pixels having different colors. Each data line provides at least two data signals, respectively, to at least two sub-pixels having the same color during different subfields. The memory stores the image data. The image data is divided into data for the first and second subfields, wherein the image data includes data corresponding to the at least two data signals. The data for the first and second subfields are arranged according to a sequence of light-emitting driving, and the arranged data are stored as pixel-based data in the memory.

BRIEF DESCRIPTION OF THE DRAWINGS

The accompanying drawings, together with the specification, illustrate exemplary embodiments of the present invention, and, together with the description, serve to explain the principles of the present invention.

FIG. 7 is an input data map of an organic light emitting display according to the first exemplary embodiment of the present invention.

FIG. 8A and FIG. 8B respectively show principles of managing an input data map of an odd field and an even field according to the first exemplary embodiment of the present invention.

FIGS. 9A and 9B are respectively an input data map of an odd field and an even field according to the first exemplary embodiment of the present invention.

FIGS. 14A and 14B are respectively an input data map of an odd field and an even field according to the second exemplary embodiment of the present invention.

DETAILED DESCRIPTION

Figure 1:
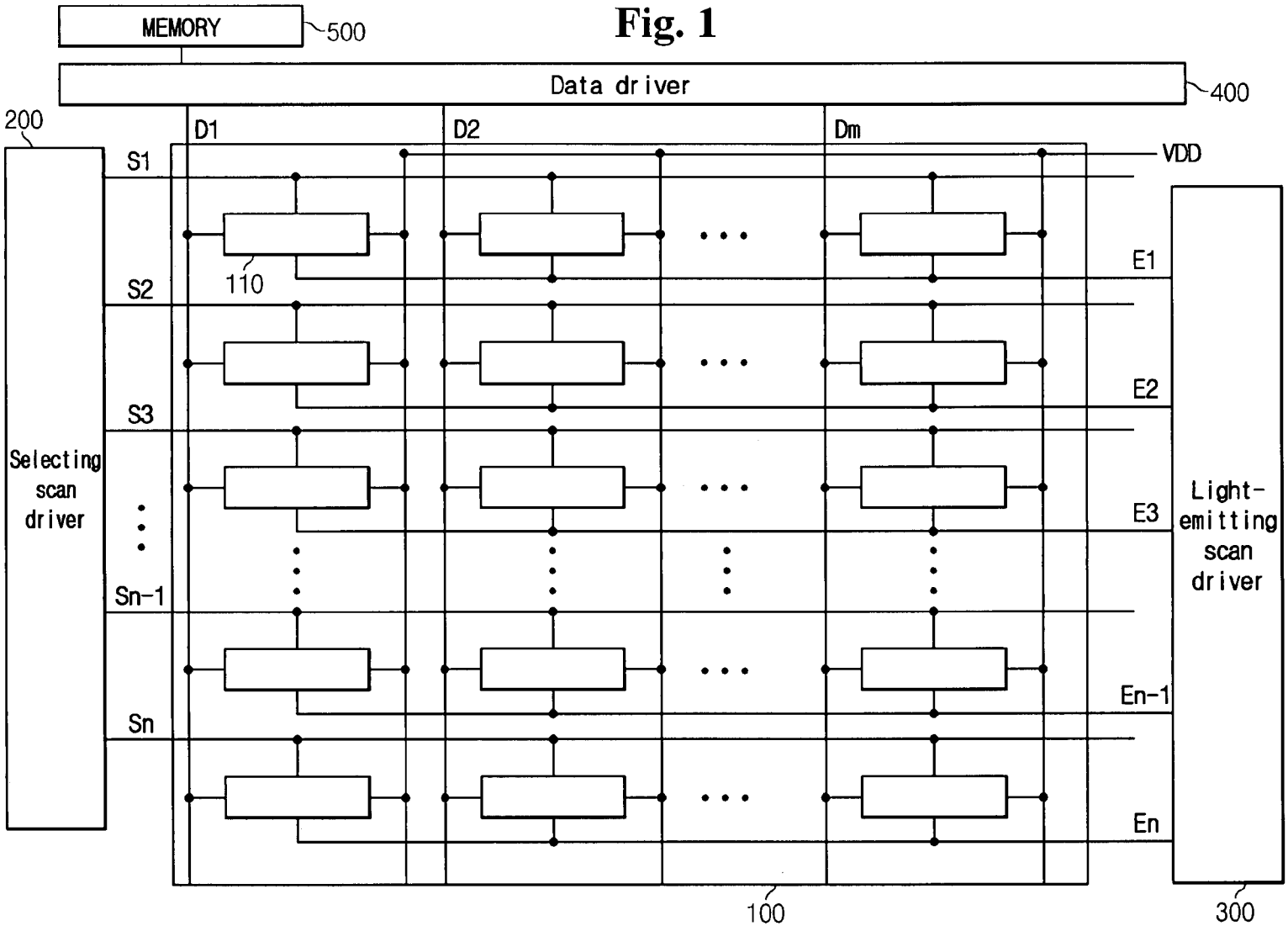
FIG. 1 is a schematic plain view of an organic light emitting display according to an exemplary embodiment of the present invention.

In the following detailed description, only certain exemplary embodiments of the invention are shown and described, simply by way of illustration. As those skilled in the art would realize, the described embodiments may be modified in various different ways, all without departing from the spirit or scope of the invention. Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements.

Hereinafter, a managing method for managing display memory data of a light emission display according to an exemplary embodiment of the present invention will be described in detail with reference to the accompanying drawings.

FIG. 1 is a schematic plain view of an organic light emitting display.

With reference to FIG. 1, an organic light emitting display according to an exemplary embodiment of the present invention includes a display panel 100, a selecting scan driver 200, a light-emitting scan driver 300, a data driver 400, and a memory 500. Input data for display images are stored in the memory 500.

The display panel 100 includes a plurality of scan lines S1 to Sn and E1 to En, arranged in a row direction, a plurality of data lines D1 to Dm arranged in a column direction, a plurality of power lines VDD, and a plurality of pixels 110. Each of the pixels 110 is formed at a pixel area defined by two neighboring scan lines S1 to Sn and two neighboring data lines D1 to Dm.

The selecting scan driver 200 sequentially applies selecting signals to the scan lines S1 to Sn so as to write data signals on the pixels coupled to the corresponding scan lines, and the light emitting scan driver 300 sequentially applies light emitting signals to the light emitting scan lines E1 to En so as to control the light emitting of an organic light emitting display. Since the light emitting signals control light emission in the organic light emitting display, they may also be referred to as "emission control signals." Similarly, the light emitting scan driver 300 may also be referred to as an emission control driver. The data driver 400 applies data signals to the data lines D1 to Dm, whenever the selecting signal is sequentially applied to the scan lines S1 to Sn.

The selecting scan driver 200, the light-emitting scan driver 300 and the data driver 400 are respectively coupled with the substrate having the display panel 100 formed thereon. However, the scan drivers 200 and 300 and/or the data driver 400 may be mounted directly on the glass substrate of the display panel 100, and they may be replaced with the driving circuit formed on the same layer as those of the scan line, the data lines, and the transistor on the substrate of the display panel 100. Also, the scan drivers 200, 300 and/or the data driver 400 may be mounted in the form of a chip at a tape carrier package (TCP), a flexible printed circuit (TCP), or a tape automatic bonding (TAB), which is coupled to the substrate of the display panel 100.

Figure 2A:
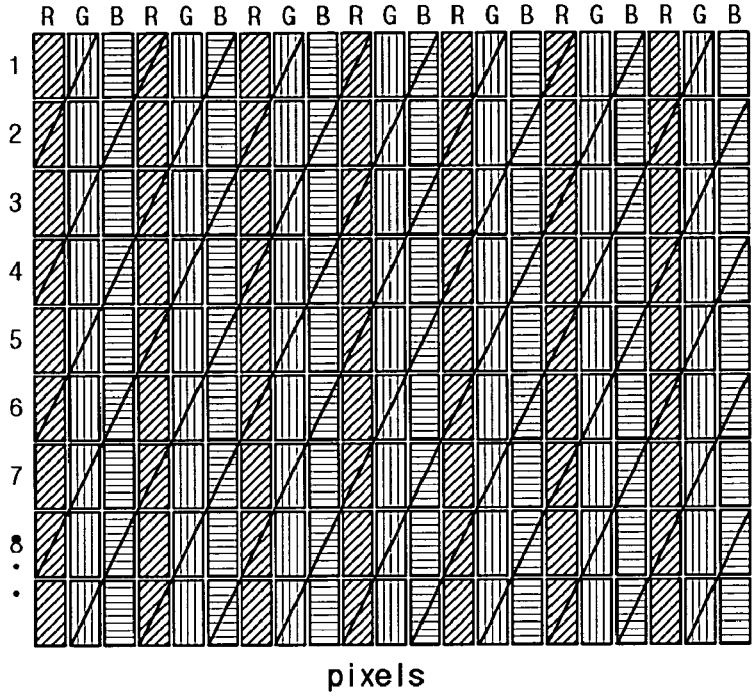
FIGS. 2A to 2C respectively show pixels and sub-pixels of an organic light emitting display according to an exemplary embodiment of the present invention.
Figure 2B:
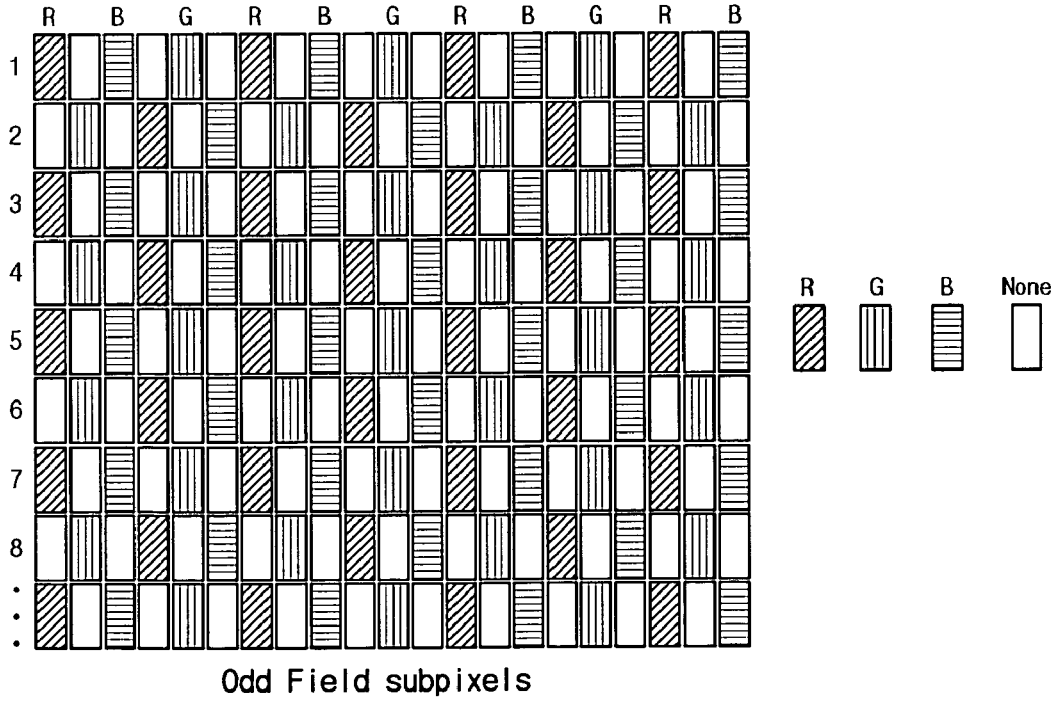
Figure 2C:
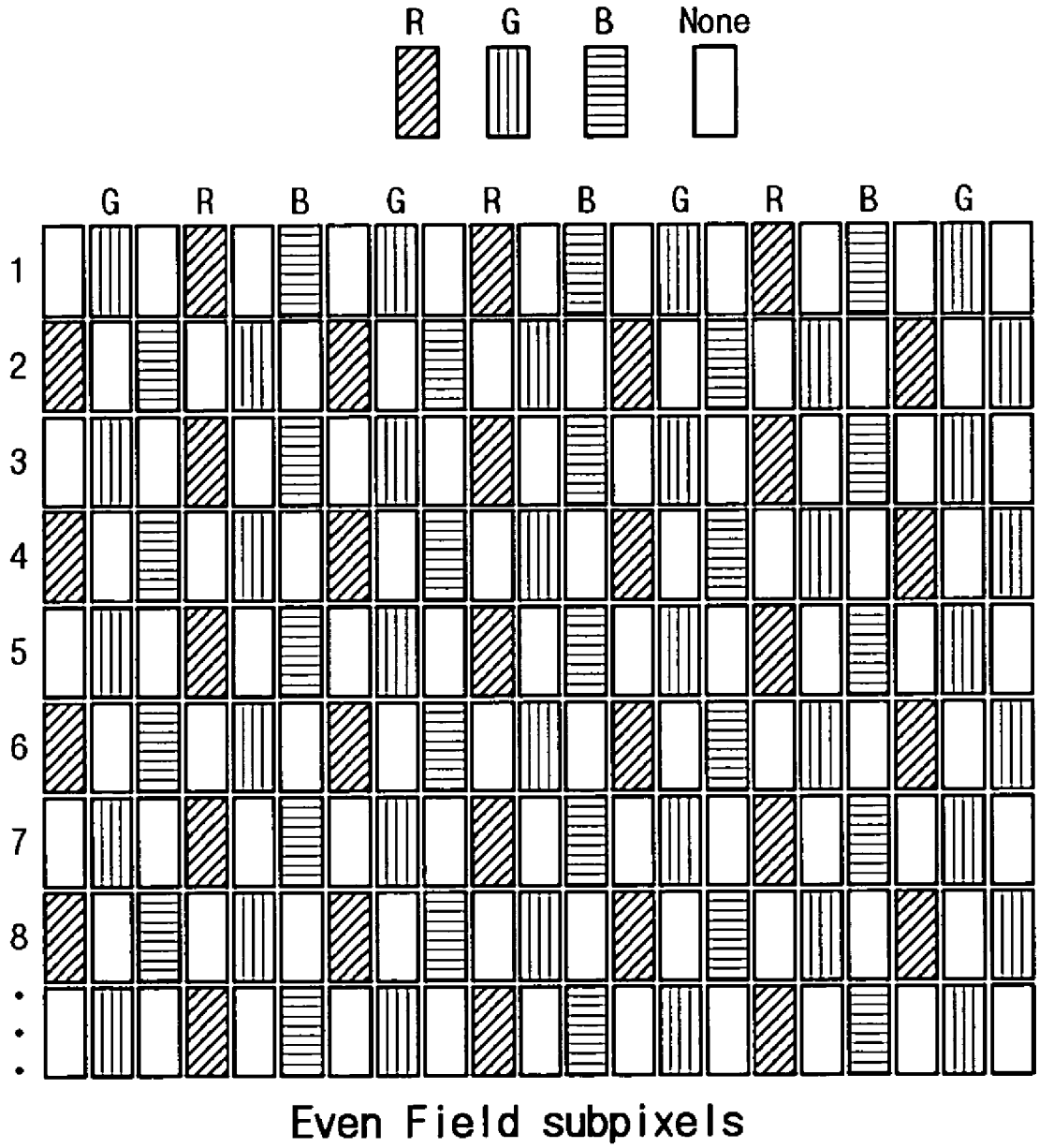

FIGS. 2A to 2C respectively show pixels and sub-pixels of an organic light emitting display according to an exemplary embodiment of the present invention. FIGS. 2A to 2C illustrate the pixel light emitting sequence of odd/even fields of a 2:1 multiplexer in the organic light emitting display according to an exemplary embodiment of the present invention.

FIG. 2A shows pixels of the organic light emitting display, where R, G, and B pixels are arranged in the column direction starting from the first line in the row direction. When the slashed pixels are removed from FIG. 2A, the sub-pixels of odd fields remain as shown in FIG. 2B, and when the slashed pixels are arranged, the sub-pixels of even fields are arranged as shown in FIG. 2C.

Figure 3:
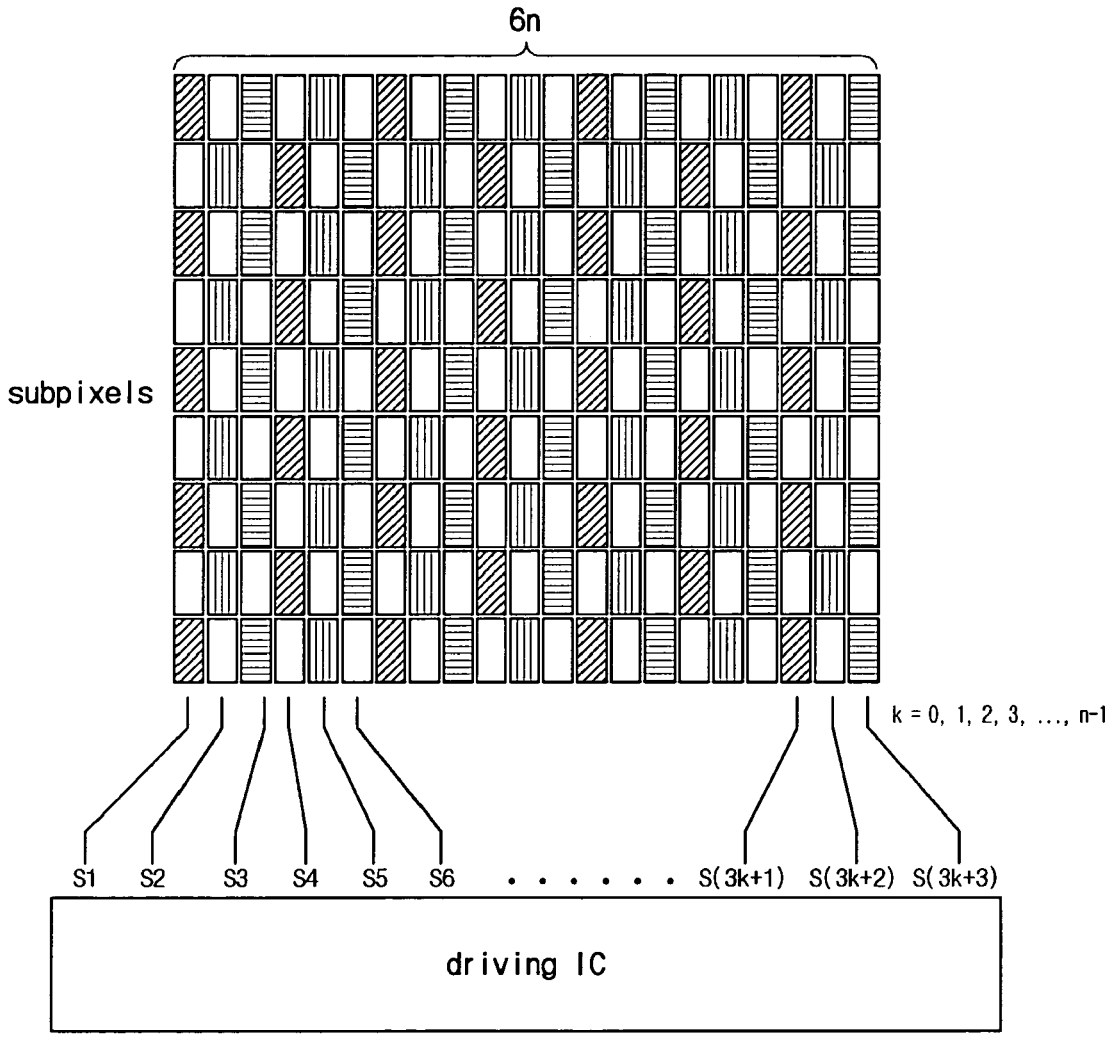
FIG. 3 shows driving of two sub-pixels according to an exemplary embodiment of the prevent invention.

FIG. 3 shows driving of two sub-pixels according to an exemplary embodiment of the present invention, where a driving IC uses one output to drive the two sub-pixels as shown in FIGS. 2B and 2C. Here, when it is given that k=0, 1, 2, 3, . . . , n−1, the outputs of the driving IC are generated to be S1, S2, S3, S4, S5, S6, . . . , S(3*k*+1), S(3*k*+2), and S(3*k*+3). The pixels are respectively classified into odd pixels and even pixels and include R, G, and B so that the number of pixels is 6n (n is a positive integer) per line.

Figure 4:
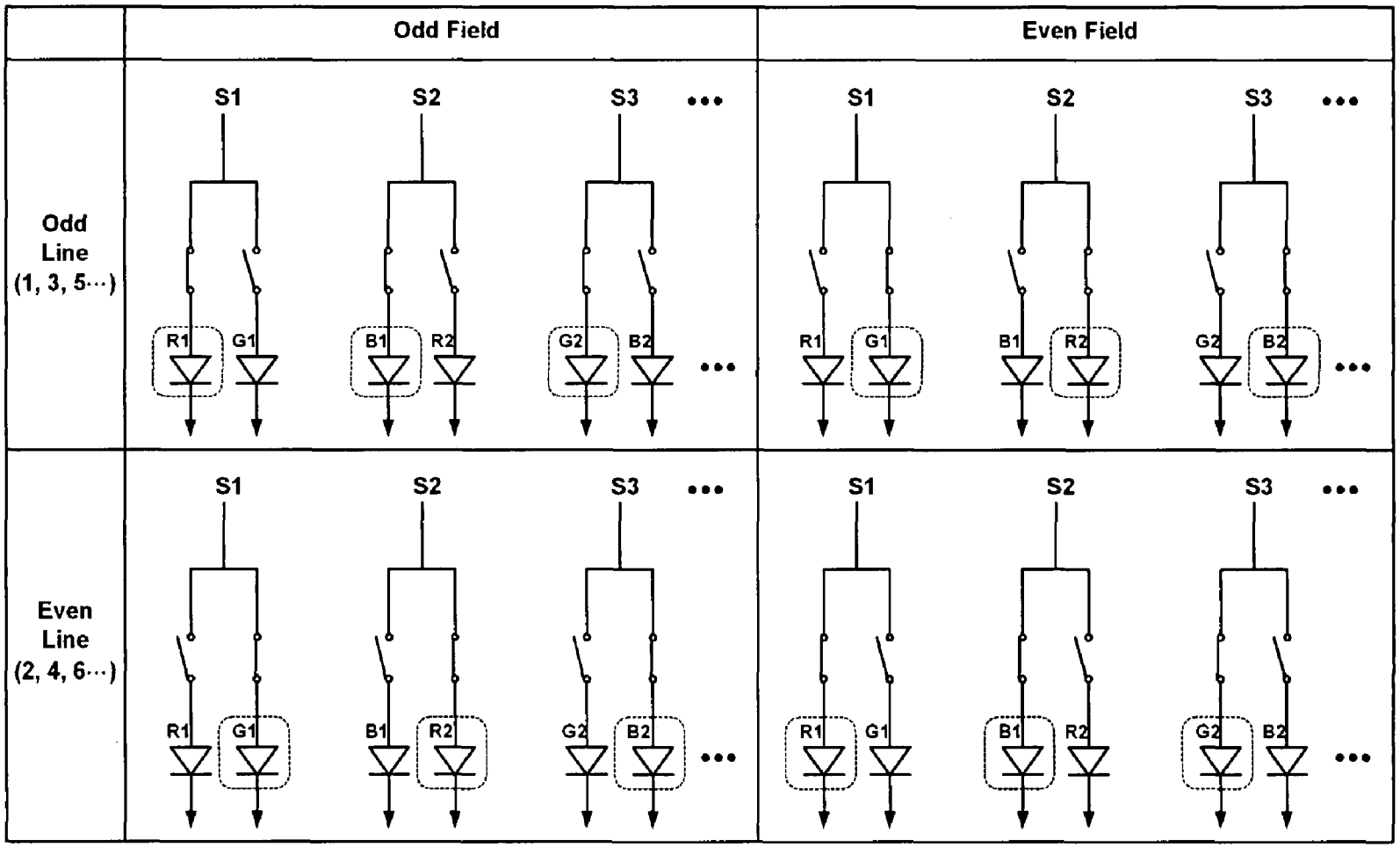
FIG. 4 schematically shows a light-emitting driving mechanism of neighboring sub-pixels according to a first exemplary embodiment of the present invention.

FIG. 4 schematically shows a light-emitting driving mechanism of adjacent sub-pixels according to a first exemplary embodiment of the present invention.

With reference to FIG. 4, in the organic light emitting display according to the first exemplary embodiment of the present invention, the light-emitting driving between adjacent sub-pixels is achieved in response to writing the data of different colors at two subfields, is executed by the odd and even fields, and each achieves the light-emitting of one of R, G, and B organic light emitting element indicated by the dotted lines at an odd line (as shown on the upper part of the drawing) and at an even line (as shown on the lower part thereof). Here, each selected signal is coupled to two adjacent organic light emitting elements, and the organic light emitting elements indicated by the dotted lines emit light starting from the first line to the final line in the column direction at the odd and even fields to make a one-frame image, generally outputting 60 frames per second.

Figure 5:
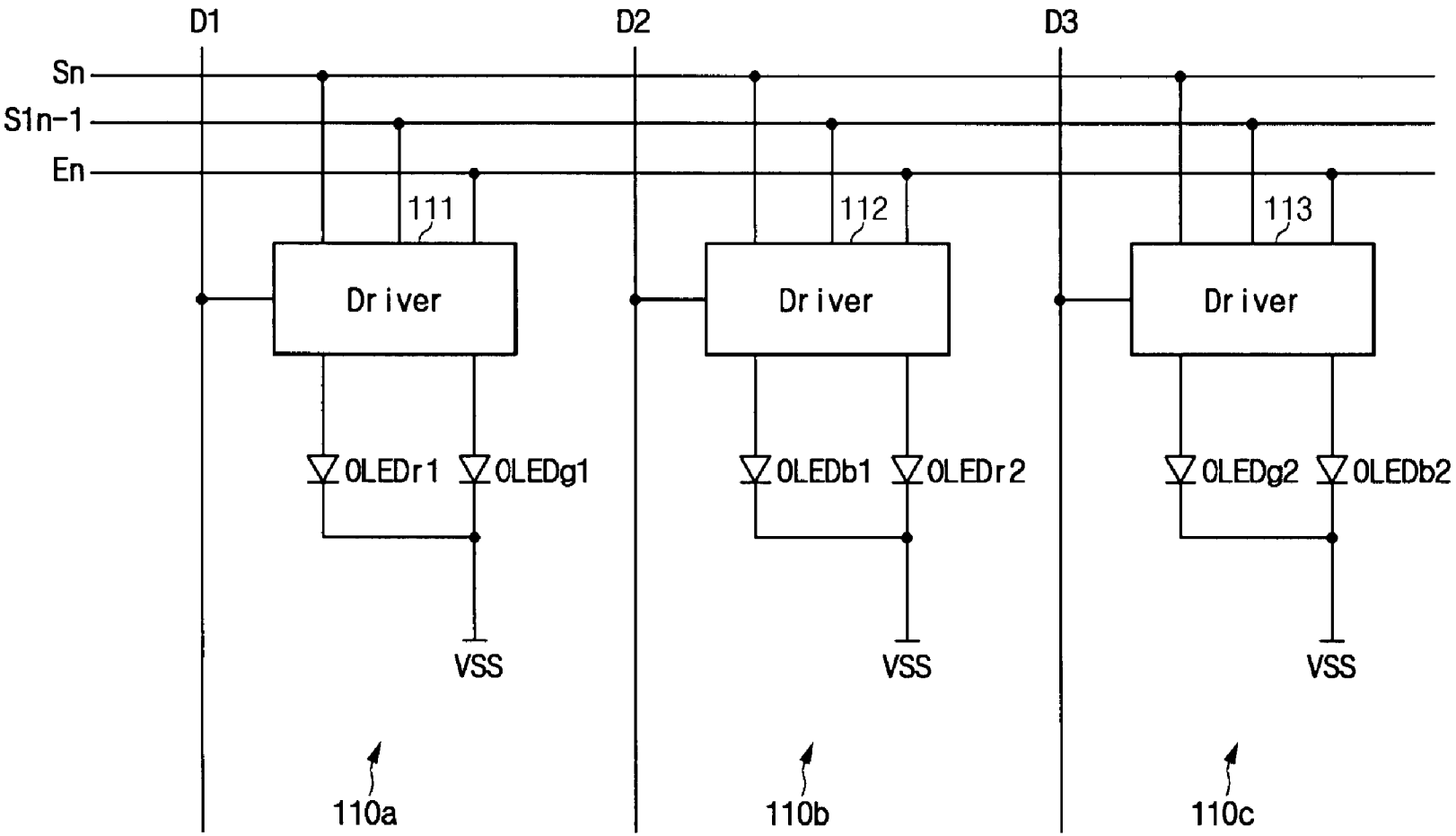
FIG. 5 schematically shows pixels of an organic light emitting display according to the first exemplary embodiment of the present invention.

FIG. 5 schematically shows pixels of an organic light emitting display according to the first exemplary embodiment of the present invention.

With reference to FIG. 5, each pixel 110*a*, 110*b* or 110*c* includes two light emitting elements for emitting light of different colors, and a driver for driving the organic light emitting elements. These organic light emitting elements emit the light of a brightness corresponding to an applied current. Hereinafter, one pixel will be defined by a driver and two organic light emitting elements formed at the pixel area, According to the first exemplary embodiment of the present invention, one field is divided into two sub-fields to be driven, and the data of different colors are written on the two sub-fields to thus emit light.

For this end, the selecting scan driver 200 (shown in FIG. 1) sequentially applies the selecting signals to the selecting scan lines S1 to Sn for each sub-field, and the light-emitting scan driver 300 applies the light emitting signal to the light-emitting scan lines E1 to En so that the organic light emitting element of each color may emit light at a single sub-field.

The data driver 400 applies the data signals to the data lines D1 to Dm, the data signals corresponding to the organic light emitting elements of different colors in two subfields. In FIG. 5, the data driver 400 applies data signals corresponding to the red and green organic light emitting elements OLEDr1 and OLEDg1 to the data line D1 in two sub-fields, applies data signals corresponding to the blue and red organic light emitting elements OLEDb1 and OLEDr2 to the data line D2, and applies data signals corresponding to the green and blue organic light emitting elements OLEDg2 and OLEDb2 to the data line D3.

Figure 6:
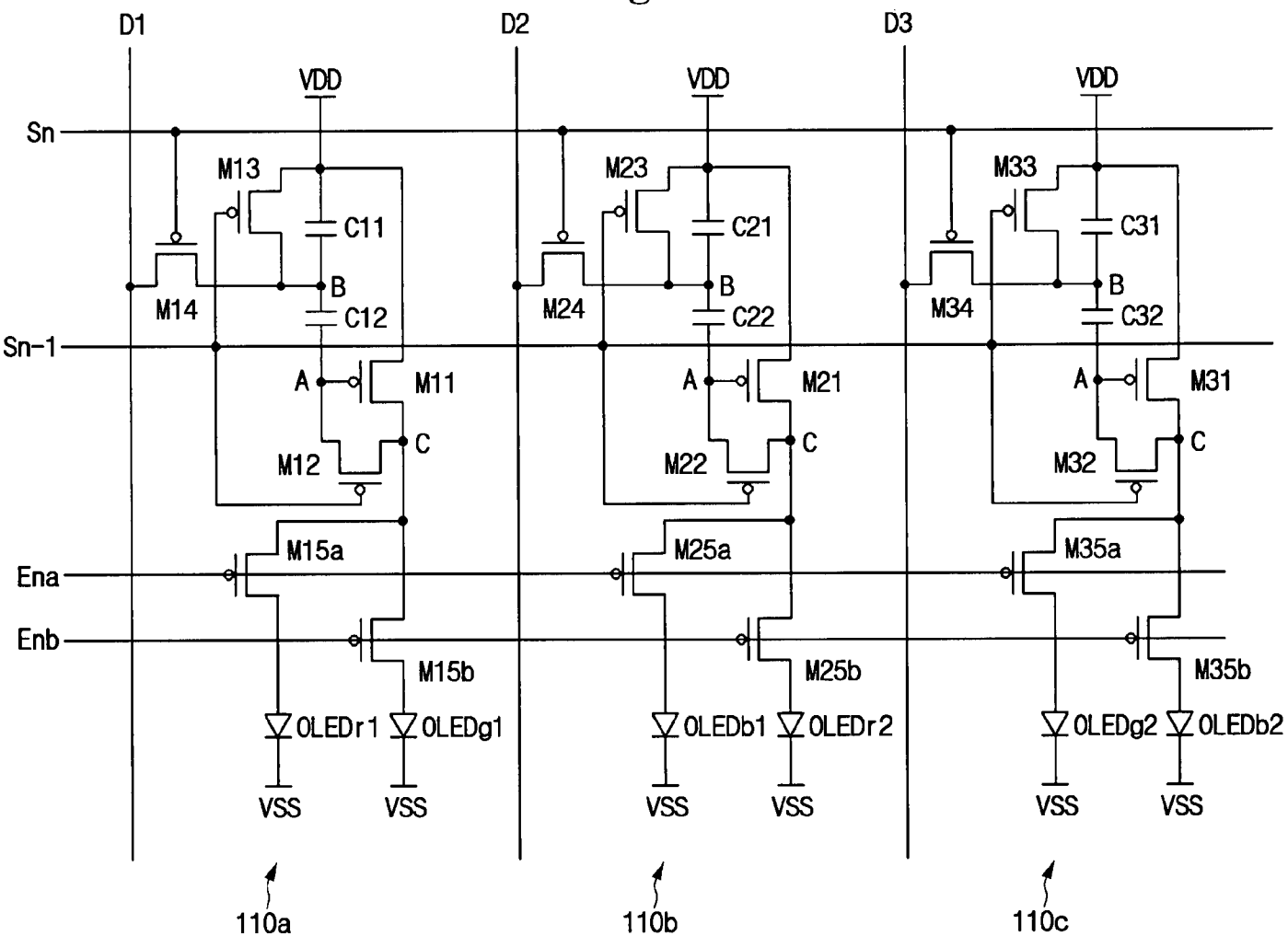
FIG. 6 shows a circuit of pixels of an organic light emitting display according to the first exemplary embodiment of the present invention.

With reference to FIG. 6, a detailed operation of an organic light emitting display according to the first exemplary embodiment of the present invention will be described.

FIG. 6 shows a circuit of a pixel of an organic light emitting display according to the first exemplary embodiment of the present invention. In FIG. 6, the pixels coupled to the data lines D1 to D3 and the selecting scan line Sn are illustrated, and transistors are illustrated to be p channel transistors.

Hereinafter, the selecting scan line which will currently transmit a selecting signal will be referred to as "the current scan line," and the selecting scan line which had transmitted a selecting signal before the current selecting signal is transmitted will be referred to as "the previous scan line."

The pixel 110*a* according to the first exemplary embodiment of the present invention includes a driving transistor M11, switching transistors M12 to M14, capacitors C11 and C12, organic light emitting elements OLEDr1 and OLEDg1, and light-emitting transistors M15*a* and M15*b* for controlling light emission of the organic light emitting elements OLEDr1 and OLEDg1. The pixel 110*b* includes a driving transistor M21, switching transistors M22 to M24, capacitors C21 and C22, organic light emitting elements OLEDb1 and OLEDr2, and light-emitting transistors M25*a* and M25*b* for controlling light emission of the organic light emitting elements OLEDb1 and OLEDr2. The pixel 110*c* includes a driving transistor M31, switching transistors M32 to M34, capacitors C31 and C32, organic light emitting elements OLEDg2 and OLEDb2, and light-emitting transistors M35*a* and M35*b* for controlling light emission of the organic light emitting elements OLEDg2 and OLEDb2. Since the operations of the three pixels 110*a* to 110*c* are substantially the same as one another, the operation of one pixel will be described based on the operation of the pixel 110*a*.

One light-emitting scan line En includes two light-emitting signal lines Ena and Enb, while the other light-emitting scan line includes two light-emitting signal lines (not shown in FIG. 6). The above-noted light-emitting transistors M15*a* and M15*b* and light-emitting signal lines Ena and Enb configure a switch for selectively transmitting the current provided by the driving transistor M11 to the organic light emitting elements OLEDr1 and OLEDg1.

The transistor M11 is a driving transistor for driving the OLED and is coupled between a power source of voltage VDD and a node of sources of the transistors M15*a* and M15*b*. The transistor M11 controls the current applied to the organic light emitting elements OLEDr1 and OLEDg1 through the transistor M15*a* and M15*b*, respectively, according to a voltage applied across the gate and source of the transistor M11. Also, the transistor M12 diode-connects the driving transistor M11 in response to the selecting signal transmitted from the previous scan line Sn−1.

One electrode A of the capacitor C12 is coupled to the gate of the driving transistor M11, and the capacitor C1 and transistor M13 are coupled in parallel between the other electrode B of the capacitor C12 and the power source of the voltage VDD. The transistor M13 supplies the voltage of VDD to the other electrode B of the capacitor C12 in response to the selecting signal provided from the previous scan line Sn−1.

Also, the switching transistor M14 transmits the data voltage supplied from the data lines Dm to the capacitor C11 in response to the selecting signal provided from the current scan line Sn. Also, the light-emitting transistors M15*a* and M15*b* are respectively coupled between the drain of the transistor M11 and anodes of the organic light emitting elements OLEDr1 and OLEDg1, and transmit the current from the transistor M11 to the organic light emitting elements OLEDr1 and OLEDg1 in response to the light-emitting signal applied from the light-emitting signal lines Ena and Enb.

The organic light emitting elements OLEDr1 and OLEDg1 respectively emit red and green lights corresponding to the applied current. In accordance with the first exemplary embodiment of the present invention, a power supply voltage of VSS, which is lower than the voltage of VDD, is applied to cathodes of the organic light emitting elements OLEDr1 and OLEDg1. The power supply voltage of VSS may be a negative voltage or the ground voltage, by way of example.

The operation of the pixel 110*a* will be described in detail.

When the low-level selecting signal is applied to the previous scan line Sn−1, the transistor M12 is turned on to diode-connect the driving transistor M11. Therefore, the voltage across the gate and source of the driving transistor M11 is varied until it reaches the threshold voltage VTH of the transistor M11. Since the voltage of VDD is applied to the source of the transistor M11, the voltage applied to the gate of the transistor M11, that is, the electrode A of the capacitor C12 becomes the voltage of (VDD+VTH). Also, the transistor M13 is turned on to apply the voltage of VDD to the other electrode B of the capacitor C12.

Since the high-level light-emitting signal is applied to the light-emitting signal lines Ena and Enb, the transistors M15*a* and M15*b* are turned off, and no current flows through the transistor M11 to the organic light emitting elements OLEDr and OLEDg.

The transistor M14 is intercepted since the high-level signal is applied to the current scan line Sn.

When the low-level selecting signal is applied to the current scan line Sn, the transistor M14 is turned on so that the data voltage VDATA is charged in the capacitor C11. Also, since the voltage corresponding to the threshold voltage VTH at the transistor M11 is charged in the capacitor C12, the sum of the data voltage VDATA and threshold voltage VTH of the transistor M11 is applied to the gate of the transistor M11.

When the light-emitting transistors M15*a* and M15*b* are respectively turned on in response to the light-emitting signals transmitted from the light-emitting signal lines Ena and Enb, the current is transmitted to the red and green organic light emitting elements OLEDr1, OLEDg1 to thus emit light.

The selecting signal is sequentially applied to the selecting scan line S1 to Sn at two sub fields included in a field, and the two light-emitting signals respectively applied to two light-emitting signal lines E1*a* to Ena and E1*b* to Enb have a low-level period which is not repeated during one field.

Also, the pixels 110*b* and 110*c* store the threshold voltages of the driving transistor M21 and M31 in the capacitors C22 and C32 while the selecting signal is applied to the previous scan line Sn−1 in a like manner as the pixel 110*a*, and store the data voltage VDATA in the capacitors C21 and C31 while the selecting signal is applied to the current scan line Sn. When the light-emitting transistors M25*a* and M35*a* are turned on in response to the light-emitting signal applied from the light-emitting signal line Ena, the currents respectively corresponding to the voltages stored in the capacitors C21 and C31 are transmitted to the blue and green organic light emitting elements OLEDb1 and OLEDg2 to thus emit light, and when the light-emitting transistors M25*b* and M35*b* are turned on in response to the light-emitting signal applied from the light-emitting signal line Enb, the currents corresponding to the voltages charged in the capacitors C21 and C31 are transmitted to the red and blue organic light emitting elements OLEDr2 and OLEDb2 to thus emit light.

FIG. 7 is an input data map of an organic light emitting display according to the first exemplary embodiment of the present invention.

With reference to FIG. 7, the data inputted from the data driver 400 of the organic light emitting display are arranged such that 6n-numbered R, G, and B pixels are arranged per line.

FIG. 8A and FIG. 8B respectively illustrate the principle to manage an input data map of odd and even fields according to the first exemplary embodiment of the present invention, illustrating that the input data map shown in FIG. 7 is divided into the memory map of the odd field and the memory map of the even field. That is to say, the input data map is separated into the odd field data as shown in FIG. 8A and the even field data as shown in FIG. 8B, respectively illustrating up to sixth R, G, and B pixels of 4 lines. The lower data surrounded by the thick line in FIGS. 8A and 8B are classified to include R, G, and B data. When 6n input data are supplied in columns, the memory map is provided with the first and second sub-field each of which has 3n data in columns.

FIG. 9A and FIG. 9B are respectively an input data map of the odd and even fields according to the first exemplary embodiment of the present invention, and when k=0, 1, 2, . . . , n−1 in the lower part of data of FIGS. 8A and 8B, three kinds of data are classified by the selecting signals S(3*k*+1), S(3*k*+2), and S(3*k*+3).

With reference to FIG. 9A, in the memory map of the odd field according to the first exemplary embodiment of the present invention, for example, since k=0 on the first line, when S(3*k*+1) is S1, the light-emitting data are stored in the range of from R(1, 1) to R(1, 6n−1), when S(3*k*+2) is S2, the light-emitting data are stored in the range of from B(1, 1) to B(1, 6n), and when S(3*k*+3) is S3, the light-emitting data are stored in the range of from G(1, 1) to G(1, 6n−1). Also, since k=0 on the second line, when S(3*k*+1) is S1, the light-emitting data are stored in the range of from G(2, 1) to G(2, 6n−1), when S(3*k*+2) is S2, the light-emitting data are stored in the range of from R(2, 2) to R(2, 6n), and when S(3*k*+3) is S3, the light-emitting data are stored in the range of from B(2, 2) to B(2, 6n). Next lines are stored in the odd-field memory map in a like manner as the above-stated description for the odd lines and even lines.

Also, with reference to FIG. 9B, in the memory map of the even field according to the first exemplary embodiment of the present invention, for example, since k=0 on the first line, when S(3*k*+1) is S1, the light-emitting data are stored in the range of from G(1, 1) to G(1, 6n−1), when S(3*k*+2) is S2, the light-emitting data are stored in the range of from R(1, 1) to R(1, 6n), and when S(3*k*+3) is S3, the light-emitting data are stored in the range of from B(1, 1) to B(1, 6n). Also, since k=0 on the second line, when S(3*k*+1) is S1, the light-emitting data are stored in the range of from R(2, 1) to R(2, 6n−1), when S(3*k*+2) is S2, the light-emitting data are stored in the range of from B(2, 1) to B(2, 6n−1), and when S(3*k*+3) is S3, the light-emitting data are stored in the range of from G(2, 2) to G(2, 6n). Next lines are stored in the even-field memory map in a like manner as the above-stated description for odd lines and even lines.

Accordingly, as shown in FIGS. 9A and 9B, the light-emitting data for adjacent sub-fields for each line are classified and stored for each sub-field.

Also, since the light-emitting element of various colors can be driven by common driving and switching transistors and a capacitor at one pixel, the constitution of the elements used in the pixel, and wiring of lines for transmitting the currents, voltages, or signals can be simplified.

However, in the case of driving the pixel according to the first exemplary embodiment of the present invention, the voltages stored in the capacitors C12 to C32 are varied according to the drain electrode of the driving transistors M11 to M31, that is, the voltage at the node C. That is to say, when the current flows through the driving transistors M11 to M31, a predetermined voltage is charged due to the drain electrode, that is, the parasitic capacitance of the node C so that the voltage at the node C depends on the level of the current input to the driving transistors M11 to M31 in the previous sub-field. Accordingly, when the low-level selecting signal is applied to the previous scan line Sn−1, one electrode A of the capacitor C12 has the same voltage VC12 as the voltage of the node C so that the voltage stored in the capacitor C12 is varied according to the voltage at the node C.

The pixels 110*a* to 110*c* according to the first exemplary embodiment of the present invention receive the current corresponding to the different colors in two subfields, so that the compensated voltage, which is stored in the capacitors C12 to C32 while the selecting signal is applied to the previous scan line Sn−1 in a single subfield, depends on the current supplied by the driving transistors M11 to M31 in the previous sub-field.

As a result, there is a problem in that the driving transistors M11 to M31 have the threshold voltages of which the deviations are insufficiently compensated because the compensated voltage is charged in the capacitors C12 to C32 according to the data voltage of the previous subfield and the data voltages corresponding to the different colors are applied in the previous subfield and the current subfield.

Also, there is a problem in that it is difficult to control the white balance of the red, green, and blue images by controlling the characteristics of the driving transistor because the pixel according to the first exemplary embodiment of the present invention has a driving transistor for driving the organic light emitting elements of different colors.

Consequently, as described hereafter, an organic light emitting display according to a second exemplary embodiment of the present invention solves the above-noted problem by controlling the driver provided at a pixel to drive organic light emitting elements of the same color.

The pixel of the organic light emitting display according to a second exemplary embodiment of the present invention will be described in detail with reference to FIGS. 10 to 14.

Figure 10:
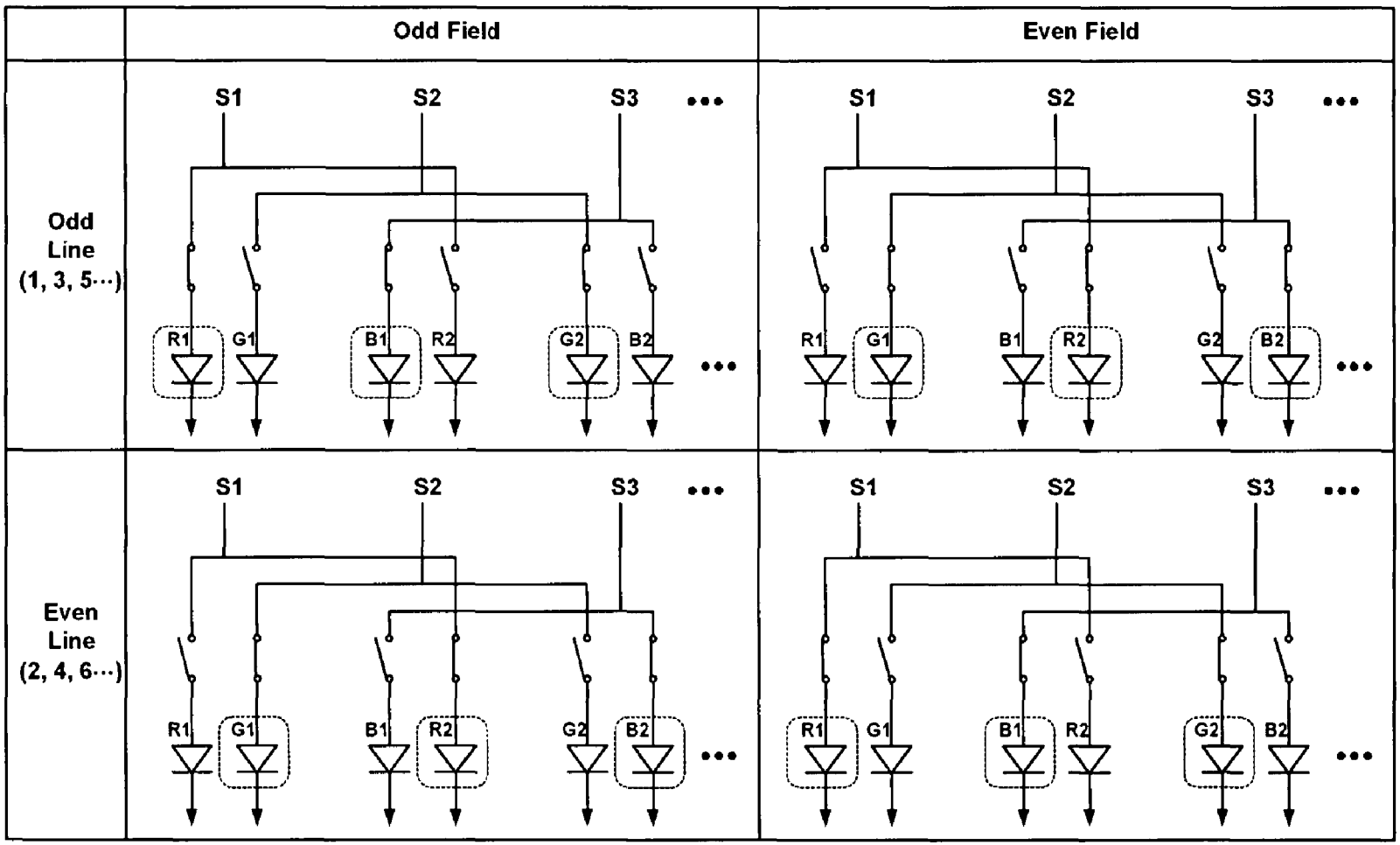
FIG. 10 schematically shows a light-emitting driving mechanism between sub-pixels of the same color according to a second exemplary embodiment of the present invention.

FIG. 10 schematically shows light-emitting driving occurring between sub-pixels of the same color according to the second exemplary embodiment of the present invention.

With reference to FIG. 10, in the organic light emitting display according to the second exemplary embodiment of the present invention, the light-emitting driving between adjacent sub-pixels is achieved in response to the writing of the data of the same color at two subfields, divided into odd and even fields, and each achieves the light-emitting of one of R, G, and B organic light emitting elements indicated by the dotted-line at an odd line (as shown at the upper part of FIG. 10) and an even line (as shown at the lower part of FIG. 10). Here, each selecting signal is coupled with two organic light emitting elements having the same color, the light-emitting of the organic light emitting elements indicated by the dotted lines at the odd and even fields is achieved according to a column direction, and is achieved up to the last line to make one frame image, generally to output 60 frames per second.

Figure 11:
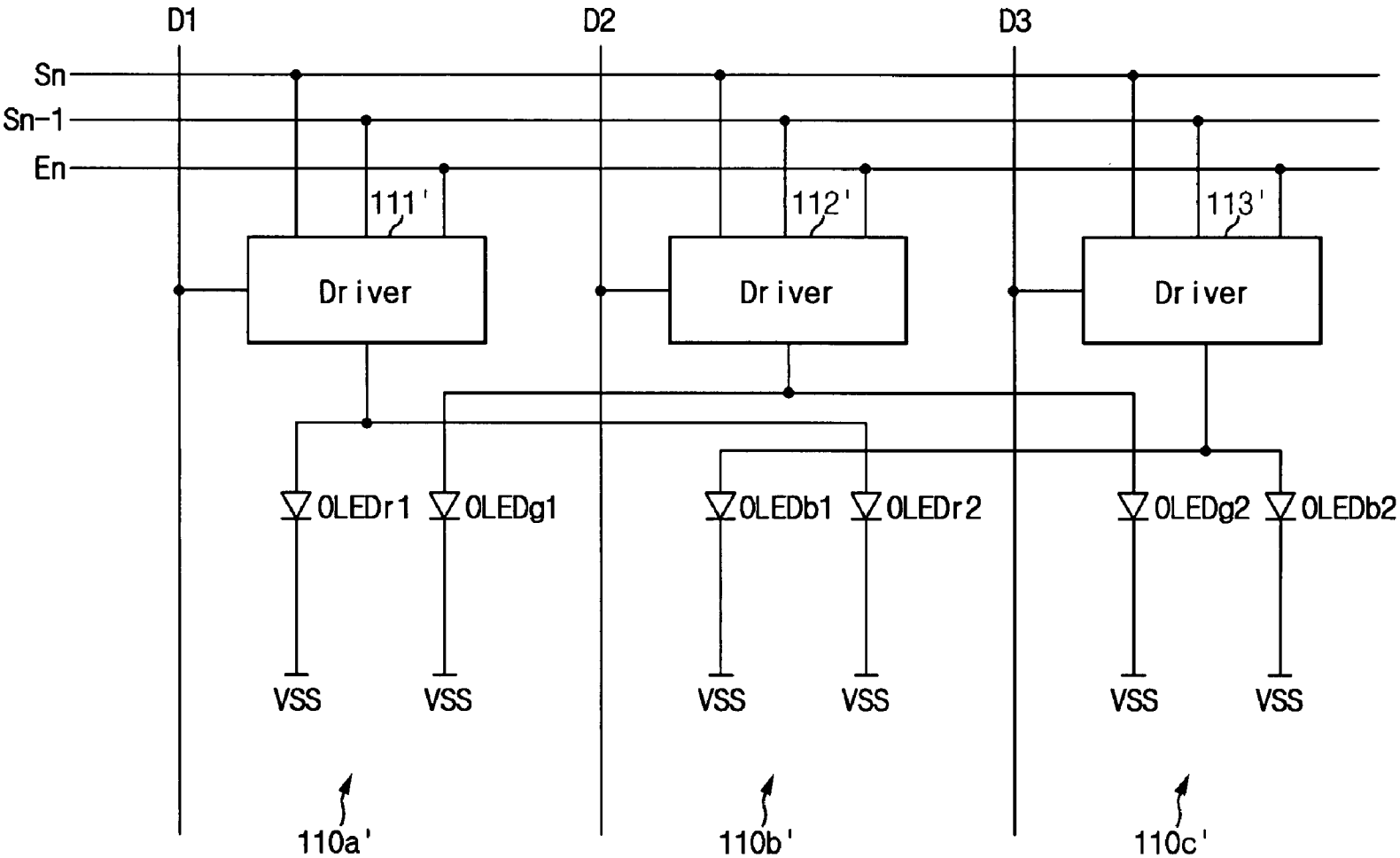
FIG. 11 schematically shows pixels of an organic light emitting display according to the second exemplary embodiment of the present invention.

Each light-emitting driving between the sub-pixels is divided. FIG. 11 schematically shows the pixel of the organic light emitting display according to the second exemplary embodiment of the present invention. In FIG. 11, three pixels 110*a*'-110*c*' coupled to data lines D1-D3 and a selecting scan line Sn are illustrated representatively.

In accordance with the second exemplary embodiment of the present invention, each of the pixels 110*a*'-110*c*' includes one of drivers 111', 112' and 113', two organic light emitting elements to emit light of different colors, and the data lines D1-D3 having the data signals corresponding to the red, green, and blue lights supplied thereto.

The driver 111' of the pixel 110*a*' is coupled to the data line D1 so that it applies the current corresponding to the data voltage transmitted from the data line D1 to the red organic light emitting elements OLEDr1 and OLEDr2. The driver 112' of the pixel 110*b*' is coupled to the data line D2 so that it applies the current corresponding to the data voltage transmitted from the data line D2 to the green organic light emitting elements OLEDg1 and OLEDg2. Further, the driver 113' of the pixel 110*c*' is coupled to the data line D3 so that it applies the current corresponding to the data voltage transmitted from the data line D3 to the blue organic light emitting elements OLEDb1 and OLEDb2.

Hereinafter, detailed operation of an organic light emitting display according to the second exemplary embodiment of the present invention is described with reference to FIG. 12. However, descriptions that are redundant to those of the first exemplary embodiment will be omitted.

Figure 12:
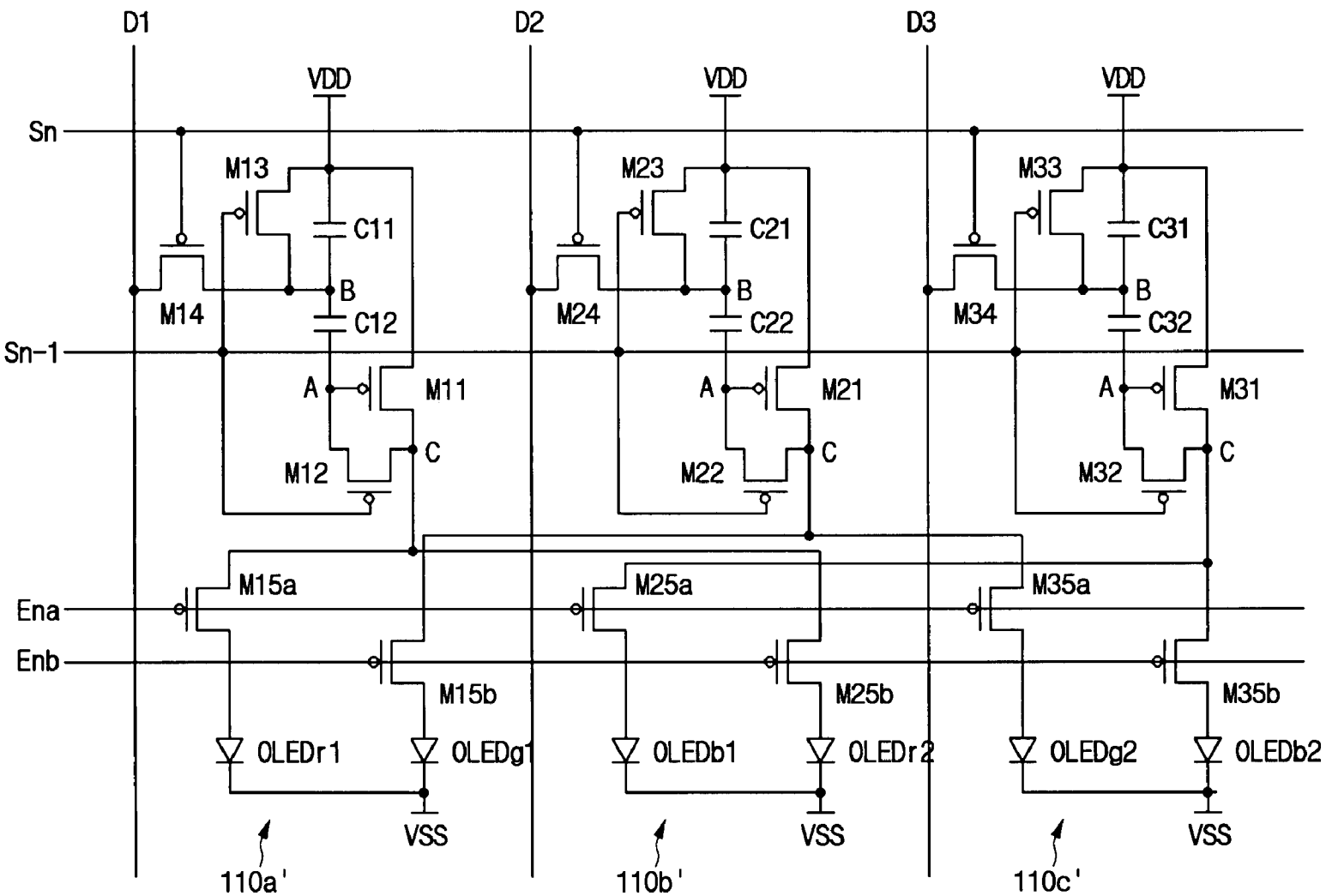
FIG. 12 is a circuit view of pixels of an organic light emitting display according to the second exemplary embodiment of the present invention.

FIG. 12 is a circuit of pixel of an organic light emitting display according to the second exemplary embodiment of the present invention.

With reference to FIG. 12, the driver of the pixel 110*a*' includes a driving transistor M11, switching transistors M12-M14, capacitors C11 and C12, and light-emitting transistors M15*a* and M15*b*. The driver of the pixel 110*b*' includes a driving transistor M21, switching transistors M22 to M24, capacitors C21 and C22, and light-emitting transistors M25*a* and M25*b*, the driver of the pixel 110*c*' includes a driving transistor M31, switching transistors M32 to M34, capacitors C31 and C32, and light-emitting transistors M35*a* and M35*b*.

According to the second exemplary embodiment, a drain of the driving transistor M11 is coupled to sources of the light-emitting transistors M15*a* and M25*b*, and the light-emitting transistors M15*a* and M25*b* transmit the current transmitted from the driving transistor M11 to the organic light emitting elements OLEDr1 and OLEDr2 in response to the light-emitting signals transmitted from the light-emitting signal lines Ena and Enb.

A drain of the driving transistor M21 is coupled with sources of the light-emitting transistors M35*a* and M15*b* so that the light-emitting transistors M35*a* and M15*b* transmit the current transmitted from the driving transistor M21 to the organic light emitting elements OLEDg1 and OLEDg2 in response to the light-emitting signals transmitted from the light-emitting signal lines Ena and Enb.

A drain of the driving transistor M31 is coupled to sources of the light-emitting transistors M25*a* and M35*b*, and the light-emitting transistors M25*a* and M35*b* transmit the current transmitted from the driving transistor M31 to organic light emitting elements OLEDb1 and OLEDb2 in response to the light-emitting signals transmitted from the light-emitting signal lines Ena and Enb.

As a result, the data voltage corresponding to the same color is applied to one data line during one field (i.e., two subfields), and the driving transistor transmits the current corresponding to the data voltage to the organic Light emitting elements of the same color.

Hereinafter, the driving method of the organic light emitting display will be described in detail with reference to FIG. 13.

Figure 13:
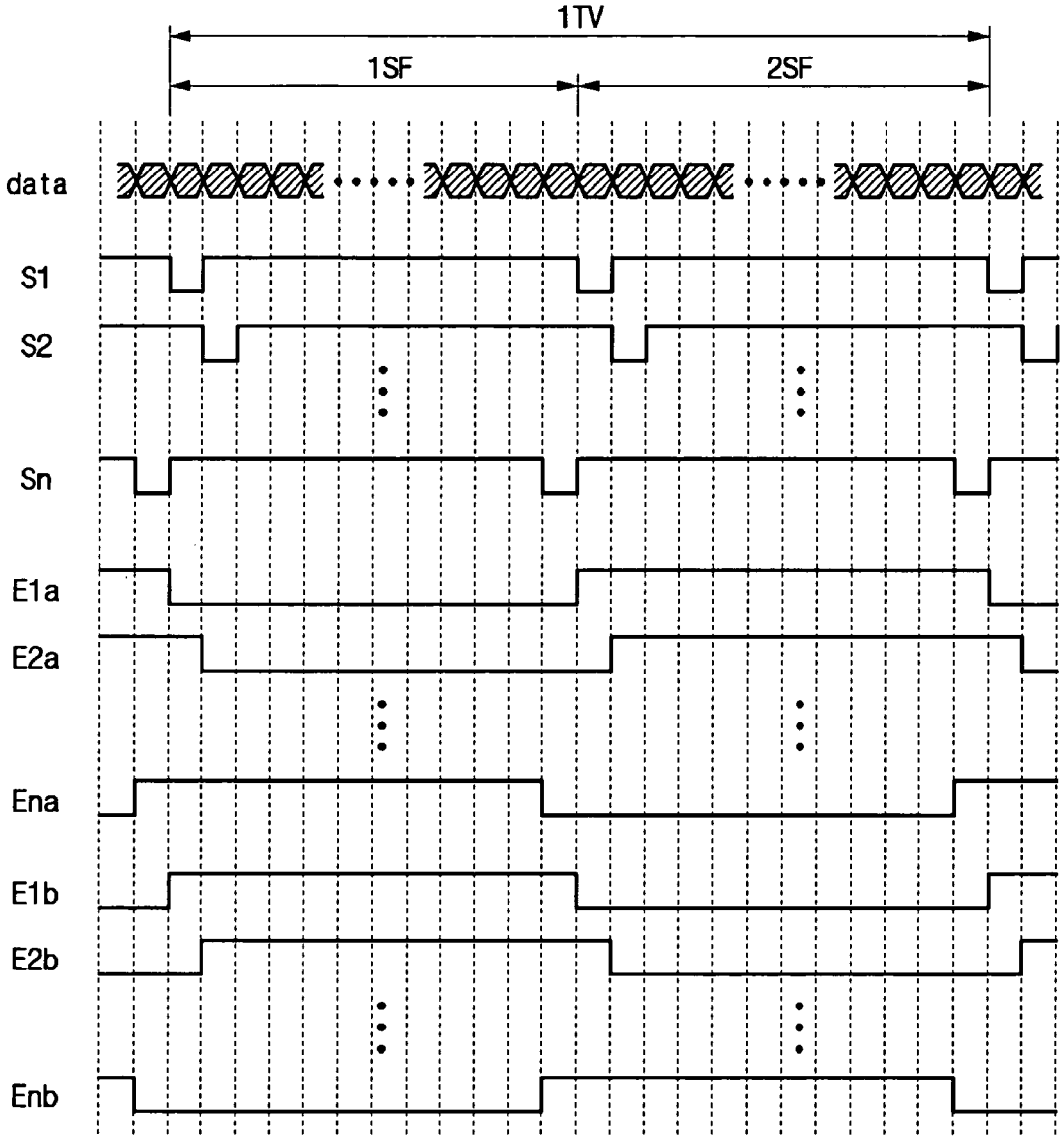
FIG. 13 is a driving timing diagram of an organic light emitting display according to the second exemplary embodiment of the present invention.

FIG. 13 is a driving timing view of the organic light emitting display according to the second exemplary embodiment of the present invention.

In the organic light emitting display according to the second exemplary embodiment, one field 1TV is divided into two subfields 1SF and 2SF to be driven, and the selection signal having a low level is sequentially applied to the scan lines S1-Sn during each of the subfields 1SF and 2SF. Each of two organic light emitting elements included in one pixel emits light during a corresponding one of the two subfields. The subfields 1SF and 2SF are defined independently for columns, and FIG. 13 shows two subfields 1SF and 2SF based on the selecting scan line S1 of the first column.

While the low-level selection signal is applied to the previous scan line Sn−1 during the subfield 1SF, the voltage corresponding to threshold voltage VTH of the driving transistors M11, M21 and M31 is stored in the capacitors C12, C22 and C32, respectively. Thereafter, when the low-level selection signal is applied to the current scan line Sn, the data voltages corresponding to the red, green, and blue colors are respectively applied to the data lines D1 to D3, and the data voltages are charged in the capacitors C11, C21 and C31 through the transistors M14, M24 and M34, respectively. Also, when the light-emitting transistors M15*a*, M35*a* and M25*a* are turned on, currents corresponding to the voltages stored in the capacitors C11, C21 and C31 are transmitted through the transistors M11, M21 and M31 to the organic light emitting elements OLEDr1, OLEDg2, and OLEDb1, respectively, to achieve the light emission.

In a like manner, data voltages are applied to the pixels of the first through nth columns during the subfield 1SF so that the left one of two organic light emitting elements emits light in each pixel.

During the next subfield 2SF, the low level selection signal is sequentially applied to the selecting scan lines S1 to Sn of first through nth columns in a like manner as in the subfield 1SF. The pixels 110*a*' to 110*c*' coupled to the current scan line Sn allow the voltage corresponding to the threshold voltage VTH of the driving transistors M11, M21 and M31 to be stored in the capacitors C12, C22 and C32, respectively, while the low level selected signal is applied to the previous scan line Sn−1 and the data voltages corresponding to the red, green and blue colors are stored in the capacitor C11, C21 and C31, respectively, while the selected signal is applied to the current scan line Sn. The low-level light-emitting signal is sequentially applied to the light-emitting signal lines E1*b*-Enb synchronized with the low level selection signals that are sequentially applied to the selecting scan lines S1-Sn. As a result, currents corresponding to the applied data voltages are transmitted to the organic light emitting elements OLEDr2, OLEDg1, and OLEDb2 through the light-emitting transistors M25*b*, M15*b*, and M35*b*, respectively, to emit light.

In accordance with the second exemplary embodiment, the light-emitting signals applied to the light-emitting signal lines E1*a* to Ena and E1*b* to Enb during the subfields 1SF and 2SF remain low level during a predetermined period, and the organic light emitting elements emit light continuously while the corresponding light-emitting signal is applied to the light-emitting transistor and the light-emitting signal remain low level. FIG. 13 shows a period that is substantially the same as this period.

That is to say, the organic light emitting elements coupled to the left part of each pixel emit light of a brightness in response to the data voltage applied during the period corresponding to the subfield 1SF, and the organic light emitting elements coupled to the right part of each pixel emit light of a brightness in response to the data voltage applied during the period corresponding to the subfield 2SF.

A data voltage corresponding to the same color is applied to each of the data lines D1-Dm during one field 1TV, and the driving transistor including one pixel transmits the current corresponding to the data voltage to the organic light emitting elements of the same color. Since the current corresponding to the same color is transmitted to the organic light emitting elements through the driving transistor during the two subfields, a voltage corresponding to the color that is the same as that of the present subfield is charged in the drain electrode of the driving transistor, the node C.

That is to say, in the case where a selection signal is applied to the previous scan line Sn−1 at the pixel 110*a*' to store the voltage corresponding to the threshold voltage of the transistor M11 in the capacitor C12, the voltage stored in the capacitor C12 depends on the voltage of the node C, and the voltage of the node C depends on the current flowed through the transistor M11 during the previous subfield as discussed above. In the second exemplary embodiment, since the driving transistor M11 outputs the current corresponding to the red color during both the previous subfield and the present subfield, the voltage for compensating the deviation of the threshold voltage of the transistor M11 under the same condition as that of the present subfield is stored in the capacitor C12.

As a result, although the drain electrode of the driving transistor M11 has a parasitic capacitance component so that a voltage different from the threshold voltage of the driving transistor M11 is stored at the capacitor C12, the voltage corresponding to the threshold voltage is stored at the capacitor C12 under the same condition as that of the present subfield and the previous subfield thereby effectively compensates the deviation of the threshold voltage of the driving transistor M11.

Since the driving transistor included in one pixel controls the current to flow into the organic light emitting elements of the same color, the driving transistor has the controlled ratio W/L of width to length of channel so that the white balance is regulated. That is, the driving transistor has the ratio W/L of width to length of channel set differently from each other so that the data voltage of the essentially same level allows a different amount of current to flow to a different one of the red, green, and blue organic light emitting elements.

FIG. 14A and FIG. 14B are respectively a memory map of an odd field and an even field according to the second exemplary embodiment of the present invention. In a like manner as the first exemplary embodiment, when k=0, 1, 2, . . . , n−1, the data of the lower part is classified into three kinds of data according to scan line selecting signals S(3*k*+1), S(3*k*+2), and S(3*k*+3).

With reference to FIG. 14A, in the memory map of the odd field according to the second exemplary embodiment of the present invention, for example, since k=0 at a first line, when S(3*k*+1) is S1, the light-emitting data are stored in the range of from R(1, 1) to R(1, 6n−1), when S(3*k*+2) is S2, the light-emitting data are stored in the ge of from G(1, 2) to G(1, 6n), and when S(3*k*+3) is S3, the light-emitting data are stored in the range of from B(1, 1) to B(1, 6n−1). Also, since k=0 at a second line, when S(3*k*+1) is S1, the light-emitting data are stored in the range of from R(2, 2) to R(2, 6n), when S(3*k*+2) is S2, the light-emitting data is stored in the range of from G(2, 1) to G(2, 6n−1), and when S(3*k*+3) is S3, the light-emitting data are stored in the range of from B(2, 2) to B(2, 6n). Thereafter, next lines are stored in the same manner as above-stated description for odd lines and even lines.

Similarly, with reference to FIG. 14B, in the memory map of the even field according to the second exemplary embodiment of the present invention, for example, since k=0 at the first line, when S(3*k*+1) is S1, the light-emitting data are stored in the range of from R(1, 2) to R(1, 6n), when S(3*k*+2) is S2, the light-emitting data are stored in the range of from G(1, 1) to G(1, 6n−1), and when S(3*k*+3) is S3, the light-emitting data are stored in the range of from B(1, 2) to B(1, 6n). Also, since k=0 at the second line, when S(3*k*+1) is S1, the light-emitting data are stored in the range of from R(2, 1) to R(2, 6n−1), when S(3*k*+2) is S2, the light-emitting data are stored in the range of from G(2, 2) to G(2, 6n), and when S(3*k*+3) is S3, the light-emitting data are stored in the range of from B(2, 1) to B(2, 6n−1). Next lines are stored in a like manner as the above-stated description for odd lines and even lines.

As a result, as shown in FIG. 14A and FIG. 14B, the light-emitting data of the sub-pixels of the same color is sorted and stored per line for each subfield.

Returning now to FIG. 12, as stated above, although the pixel driver according to the second exemplary embodiment includes a driving transistor, four switching transistors, two capacitors, and two light-emitting elements, the principles of the second exemplary embodiment can be applied to organic light emitting displays having various different types of pixels, and are not limited to being applied to the pixels as shown in FIG. 12.

In other pixels of the organic light emitting display where the principles of the second exemplary embodiment are applied, since the driving transistor drives the organic light emitting elements to emit lights of the same color, the white balance can be controlled by regulating the width and length of the channel of the driving transistor.

For example, although FIG. 13 shows a progressive scan driving of a single scan type of organic light emitting display, the present invention may be applied to a dual scan type, interlaced scan type, or any other suitable scan type of organic light emitting display.

Also, although FIG. 12 shows one pixel including two organic light emitting elements, one pixel in other embodiments may include three organic light emitting elements and emit red, green, and blue lights. In this case, the pixel circuit should be driven with one field divided into three subfields.

According to the present invention, a light-emitting display sorts display data into a form that can be read easily from the memory, and stores and manages the sorted display data thereby reducing the data access time and enhancing the memory efficiency.

While this invention has been described in connection with certain exemplary embodiments, it is to be understood that the present invention is not limited to the disclosed embodiments, but, on the contrary, is intended to cover various modifications and equivalent arrangements included within the spirit and scope of the appended claims.

What is claimed is:

1. A memory managing method for display data of a light emitting display device, wherein a plurality of pixels each includes at least two sub-pixels for emitting different color light, each of a plurality of fields is divided into a plurality of subfields including a first subfield and a second subfield, at least two data signals corresponding to sub-pixels for emitting the same color light are time-divided and are applied to a data line in the fields having the plurality of subfields, and selecting signals are sequentially applied to each of a plurality of scan lines in the first subfield and are then sequentially applied to each of the plurality of scan lines in the second subfield, the method comprising:

a) dividing the display data of a display image into data for the first and second subfields, wherein for each of the plurality of fields, data for the first subfield is applied to only some of the sub-pixels and data for the second subfield is applied to the sub-pixels to which data for the first subfield was not applied, and the display data includes data corresponding to the at least two data signals;

b) arranging the data for the first and second subfields according to a sequence of light-emitting driving; and c) storing the arranged data as pixel-based data.

2. The memory managing method for display data of a light emitting display device as claimed in claim 1, wherein the light-emitting driving of b) comprises time-divided driving of adjacent sub-pixels.

3. The memory managing method for display data of a light emitting display device as claimed in claim 1, wherein the light-emitting driving of b) comprises time-divided driving of sub-pixels of the same color.

4. The memory managing method for display data of a light emitting display device as claimed in claim 1, wherein the pixel-based data of c) are stored according to a predetermined sequence of reading the data from a memory in accordance with a memory map of the memory.

5. The memory managing method fbr display data of a light emitting display device as claimed in claim 4, wherein when 6n sub-pixels are arranged in a row direction, the memory map is configured such that 3n data in a column direction is read for each of the first and second subfields when 6n display data are supplied in a column direction, wherein n is a positive integer.

6. The memory managing method for display data of a light emitting display device as claimed in claim 4, wherein when 6n sub-pixels are comprised in each line, the memory map corresponds to the scan lines for selecting signals S(3*k*+1), S(3*k*+2) or S(3*k*+3) where k=0, 1, 2, . . . , n−1 for each line.

7. A light emitting display device comprising:

a data driver for providing a plurality of data signals over a plurality of data lines during a plurality of fields each including at least first and second subfields;

a scan driver for respectively providing a plurality of selecting signals over each of a plurality of scan lines in a first subfield of the at least first and second subfields and then over each of the plurality of scan lines in a second subfield of the at least first and second subfields;

a plurality of pixels coupled to the data lines and the scan lines, each pixel comprising at least two sub-pixels having different colors, wherein each data line provides at least two data signals, respectively, to at least two sub-pixels having the same color during different subfields; and a memory for storing the image data, wherein the image data is divided into data for the first and second subfields, and wherein for each of the plurality of fields, data for the first subfield is applied to only some of the sub-pixels and data for the second subfield is applied to the sub-pixels to which data for the first subfield was not applied, the image data includes data corresponding to the at least two data signals, the data for the first and second subfields are arranged according to a sequence of light-emitting driving, and the arranged data are stored as pixel-based data in the memory.

8. The light emitting display device of claim 7, wherein the light-emitting driving comprises time-divided driving of adjacent sub-pixels.

9. The light emitting display device of claim 7, wherein the light-emitting driving comprises time-divided driving of the sub-pixels of the same color.

10. The light emitting display device of claim 7, wherein the pixel-based data are stored in the memory according to a predetermined sequence of reading the data according to a memory map of the memory.

11. The light emitting display device of claim 10, wherein when 6n sub-pixels are arranged in a row direction, the memory map is configured such that 3n data in a column direction is read for each of the first and second subfields when 6n display data are supplied in a column direction, wherein n is a positive integer.

12. The light emitting display device of claim 10, wherein when 6n sub-pixels are comprised in each line, the memory map corresponds to the scan lines for selecting signals S(3*k*+1), S(3*k*+2) or S(3*k*+3) where k=0, 1, 2, . . . , n−1 for each line.

* * * * *

UNITED STATES PATENT AND TRADEMARK OFFICE

CERTIFICATE OF CORRECTION

PATENT NO. : 8,154,481 B2
APPLICATION NO. : 11/208440
DATED : April 10, 2012
INVENTOR(S) : Kyoung-Soo Lee et al.

It is certified that error appears in the above-identified patent and that said Letters Patent is hereby corrected as shown below:

In the Claims

Column 13, Claim 5, line 57. Delete "fbr"

Insert -- for --

Signed and Sealed this
Twenty-seventh Day of August, 2013

Teresa Stanek Rea
*Acting Director of the United States Patent and Trademark Office*